US012781331B2

(12) United States Patent
Yamashiro et al.

(10) Patent No.: US 12,781,331 B2
(45) Date of Patent: Nov. 3, 2026

(54) METHOD FOR MANUFACTURING HOT-DIP METAL-COATED STEEL STRIP

(71) Applicant: JFE Steel Corporation, Tokyo (JP)

(72) Inventors: Kenji Yamashiro, Tokyo (JP); Hideyuki Takahashi, Tokyo (JP); Yu Terasaki, Tokyo (JP); Yoshihiko Kaku, Tokyo (JP); Takumi Koyama, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 249 days.

(21) Appl. No.: 18/688,060

(22) PCT Filed: Aug. 25, 2022

(86) PCT No.: PCT/JP2022/032019

§ 371 (c)(1),
(2) Date: Feb. 29, 2024

(87) PCT Pub. No.: WO2023/037881

PCT Pub. Date: Mar. 16, 2023

(65) Prior Publication Data

US 2024/0352569 A1 Oct. 24, 2024

(30) Foreign Application Priority Data

Sep. 10, 2021 (JP) ..... 2021-147458

(51) Int. Cl.

| | |
|---|---|
| ***C23C 2/06*** | (2006.01) |
| ***C23C 2/20*** | (2006.01) |
| ***C23C 2/40*** | (2006.01) |

(52) U.S. Cl.

CPC ..... *C23C 2/20* (2013.01); *C23C 2/06* (2013.01); *C23C 2/40* (2013.01)

(58) Field of Classification Search

CPC ..... C23C 2/20; C23C 2/06; C23C 2/40; C23C 2/16; C23C 2/18; C23C 2/003; B05C 11/06

See application file for complete search history.

(56) References Cited

U.S. PATENT DOCUMENTS 3,459,587 A 8/1969 Hunter et al.
3,681,118 A * 8/1972 Ohama et al. ..... C23C 2/20 427/349

(Continued)

FOREIGN PATENT DOCUMENTS

EP 3 205 741 A1 8/2017
EP 3 287 541 B1 7/2019

(Continued)

OTHER PUBLICATIONS

WO-2020039869-A1 English translation (Year: 2020).*

(Continued)

*Primary Examiner* — Hai Y Zhang
(74) *Attorney, Agent, or Firm* — Buchanan Ingersoll & Rooney PC

(57) ABSTRACT

Provided is a method for manufacturing a hot-dip metal-coated steel strip. The method includes continuously dipping a steel strip in a molten metal bath, injecting a gas from gas injection ports of paired gas wiping nozzles arranged on both front and back surface sides of the steel strip onto the steel strip pulled-up from the molten metal bath to adjust an adhesion amount of molten metal which adheres to both surfaces of the steel strip, and continuously manufacturing a hot-dip metal-coated steel strip, in which the paired gas wiping nozzles are operated under defined conditions.

6 Claims, 13 Drawing Sheets

(56) References Cited

U.S. PATENT DOCUMENTS

| | | | | |
|---|---|---|---|---|
| 3,865,298 | A | 2/1975 | Allen et al. | |
| 2021/0310109 | A1 * | 10/2021 | Terasaki | C23C 2/18 |

FOREIGN PATENT DOCUMENTS

| | | | | |
|---|---|---|---|---|
| JP | S50-045965 | A | 4/1975 | |
| JP | S512055 | B1 | 1/1976 | |
| JP | S5134902 | Y1 | 8/1976 | |
| JP | H05306449 | A | 11/1993 | |
| JP | 2000328218 | A | 11/2000 | |
| JP | 2011-068951 | A | 4/2011 | |
| JP | 2014080673 | A | 5/2014 | |
| JP | 2018-145527 | A | 9/2018 | |
| JP | 2020190005 | A | 11/2020 | |
| WO | WO-2020039869 | A1 * | 2/2020 | C23C 2/0038 |

OTHER PUBLICATIONS

International Search Report (PCT/ISA/210) with English translation and Written Opinion (PCT/ISA/237) mailed on Nov. 15, 2022, by the Japanese Patent Office as the International Searching Authority for International Application No. PCT/JP2022/032019.

Office Action (Request for the Submission of an Opinion) issued Oct. 3, 2025, by the Korean Intellectual Property Office in corresponding Korean Patent Application No. 10-2024-7007148 and an English translation with the Concise Statement of Relevance of the Office Action. (10 pages).

Office Action (Notice of Reasons for Refusal) issued Jan. 9, 2024, by the Japan Patent Office in corresponding Japanese Patent Application No. 2022-573495 and an English translation with Concise Statement of Relevance of the Office Action. (12 Pages).

The extended European Search Report issued Mar. 6, 2024, by the European Patent Office in corresponding European Patent Application No. 22867203.6-1103. (14 pages).

Office Action (Examination report No. 1 for standard patent application) issued Feb. 1, 2025, by the Australian Government, IP Australia in corresponding Australian Patent Application No. 2022341700. (3 pages),.

Office Action (The First Office Action) issued Mar. 25, 2026, by the State Intellectual Property Office of People's Republic of China in corresponding Chinese Patent Application No. 202280059496.2 and an English translation with Concise explanation of relevance of the Office Action. (21 pages).

Office Action (Decision of Refusal) issued Nov. 5, 2024, by the Japan Patent Office in corresponding Japanese Patent Application No. 2022-573495 and an English translation with Concise Statement of Relevance of the Office Action. (8 pages).

* cited by examiner (b) FLYING DIRECTION OF SPLASH (a) IMPINGEMENT OF JET FLOWS FACING EACH OTHER (b) θ=65°

(a) θ=30°

θ=10°

θ=15°

θ=30°

METHOD FOR MANUFACTURING HOT-DIP METAL-COATED STEEL STRIP

CROSS REFERENCE TO RELATED APPLICATIONS

This is the U.S. National Phase application of PCT/JP2022/032019, filed Aug. 25, 2022, which claims priority to Japanese Patent Application No. 2021-147458, filed Sep. 10, 2021, the disclosures of these applications being incorporated herein by reference in their entireties for all purposes.

FIELD OF THE INVENTION

The present invention relates to a method for manufacturing a hot-dip metal-coated steel strip.

BACKGROUND OF THE INVENTION

A hot-dip galvanized steel sheet, which is a kind of hot-dip metal-coated steel sheet, is widely used in the industrial fields of building materials, automobiles, home electric appliances, and the like. In such fields of use, the hot-dip galvanized steel sheet is required to be excellent in terms of surface appearance. Here, since surface appearance after painting is influenced strongly by surface defects such as a variation in coating film thickness, flaws, foreign matter adhesion, and the like, it is important for the hot-dip galvanized steel sheet to have no surface defects.

Generally, in a continuous hot-dip metal coating line, a steel strip, which is a kind of metal strip annealed by using a continuous annealing furnace in a reducing atmosphere, is fed through a snout into a molten metal bath in a coating tank. Then, the steel strip is pulled up above the molten metal bath via a sink roll and support rolls which are placed in the molten metal bath. Subsequently, a wiping gas is injected onto the surfaces of the steel strip through gas wiping nozzles which are arranged on both the front and back surface sides of the steel strip to blow off excess of molten metal which has been pulled up adhering to the surfaces of the steel strip. With this, the adhesion amount of the molten metal (hereafter, also referred to as "coating weight") is adjusted. Here, since the gas wiping nozzles are usually constructed to have a width wider than the width of the steel strip so as to be effective over a wide range of steel strip widths and so as to respond to, for example, the positional shift in the width direction of the steel strip occurring when the steel strip is pulled up, the gas wiping nozzles extend beyond the edges of the steel strip in the width direction of the steel strip. In the case of using such a gas wiping method, the molten metal dropping downward scatters due to turbulent gas jet flow caused by the impingement with the steel strip, and the scattered molten metal solidifies and forms fine metal powder, that is, so-called splash, which adheres to the steel strip and causes a defect (splash defect), thereby resulting in a deterioration in the surface quality of the steel strip.

In addition, to increase the production quantity in such a continuous process, the passing speed of the steel strip may be increased. However, in the case where the coating weight is controlled by using the gas wiping method in the continuous hot-dip coating process, the wiping gas pressure has to be increased so as to control the coating weight to be within a predetermined range. As a result, there is a significant increase in the amount of splash, and it is difficult to maintain good surface quality.

To solve the problems described above, the following techniques have been disclosed.

Patent Literature 1 describes a method for preventing the droplets of molten metal from adhering to the surface of a strip in a hot-dip coating process. In the method according to Patent Literature 1, a metal plate is placed between a main pipe for supplying a wiping gas and wiping nozzles. Moreover, a filter is placed along a steel sheet between the main pipe for supplying the wiping gas and an alloying furnace. In the technique according to Patent Literature 1, when the metal droplets generated on the liquid surface of the coating bath fly around the outside of the wiping nozzles toward the steel sheet which has been subjected to wiping, the droplets are removed by the filter, which results in splash being prevented from adhering to the steel sheet.

Patent Literature 2 discloses a method for preventing splash from adhering to a coated steel strip by placing a flow-control plate overhanging the back side of a wiping nozzle and by placing a weir on the upper front part of the wiping nozzle.

Patent Literature 3 proposes a method for inhibiting splash defects by placing side nozzles above wiping nozzles and by injecting a gas through the side nozzles toward turbulent gas flow in a region in which gas-gas impingement occurs in a wiping gas.

PATENT LITERATURE

PTL 1: Japanese Unexamined Patent Application Publication No. 5-306449

PTL 2: Japanese Unexamined Patent Application Publication No. 2000-328218

PTL 3: Japanese Unexamined Patent Application Publication No. 2014-80673

SUMMARY OF THE INVENTION

However, it was found that, in the case of the method disclosed in Patent Literature 1, there is an insufficient effect of preventing a splash defect from occurring. That is, in the case where the mesh of the filter is large, the filter has no effect. On the other hand, in the case where the mesh of the filter is small, it is possible to inhibit splash flying upward around the outside of the filter from adhering to the surfaces of the strip. However, splash directly entering a gap between the filter and the metal plate without flying upward around the back of the wiping nozzles is less likely to be discharged to the outside of the filter. Therefore, there is an insufficient effect of preventing a splash defect from occurring.

In addition, in the case of the method disclosed in Patent Literature 2, it is difficult to prevent splash flying upward around the back of the wiping nozzles from adhering to the coated steel strip. Besides, splash (metal powder) deposited on the flow-control plate overhanging the back side of the wiping nozzle during operation scatters again due to a change in a wiping gas flow caused by changes in the wiping conditions (wiping gas pressure, nozzle height, and the like). Since such a phenomenon becomes more noticeable with time, it was found that, in the case of the method according to Patent Literature 2, it is difficult to stably prevent splash adhesion.

In the case of the method disclosed in Patent Literature 3, it is possible to inhibit splash from adhering to a steel sheet. However, it was found that, since the gas injected through the side nozzles blows off the splash, the splash which has been blown off enters the wiping nozzle slit and causes nozzle clogging, which results in a streaky defect occurring in the steel sheet.

Aspects of the present invention have been made in view of the situation described above, and an object according to aspects of the present invention is to provide a method for manufacturing a hot-dip metal-coated steel strip with which it is possible to inhibit splash defects from occurring by inhibiting splash from adhering to the steel strip.

The subject matter according to aspects of the present invention to solve the problems described above includes the following.

[1] A method for manufacturing a hot-dip metal-coated steel strip, the method including: continuously dipping a steel strip in a molten metal bath; pulling up the steel strip from the molten metal bath; injecting a gas onto the pulled-up steel strip by using paired gas wiping nozzles arranged on both front and back surface sides of the steel strip, the paired gas wiping nozzles having slit gas injection ports extending in a width direction of the steel strip to a range wider than a width of the steel strip, the gas being injected through the slit gas injection ports to adjust an adhesion amount of molten metal which adheres to both surfaces of the steel strip; and continuously manufacturing a hot-dip metal-coated steel strip, in which, when a graph is drawn in such a manner that a horizontal axis represents an angle θ (°) between an injection direction of the gas injected through each of the gas injection ports and a horizontal plane and a vertical axis represents a ratio D/B of a distance D (mm) between a front edge of the gas injection port and the steel strip to a width B (mm) of the gas injection port, the paired gas wiping nozzles are operated under conditions in a range enclosed by lines expressed by (equation 1) to (equation 5) below:

$$D/B = 3 \quad \text{(equation 1)}$$

$$D/B = 0.1 \times \theta + 9 \quad \text{(equation 2)}$$

$$D/B = 12 \quad \text{(equation 3)}$$

$$\theta = 10 \quad \text{(equation 4)}$$

$$\theta = 60 \quad \text{(equation 5)}$$

[2] The method for manufacturing a hot-dip metal-coated steel strip according to item [1], in which a distance H between each front edge of the gas injection ports of the paired gas wiping nozzles and a liquid surface of the molten metal bath is 50 mm or more and 700 mm or less, and in which a temperature T (° C.) of the gas immediately after injected through the paired gas wiping nozzles satisfies a relational expression $TM-150 \leq T \leq TM+250$ in relation to a melting point TM (° C.) of the molten metal.

[3] The method for manufacturing a hot-dip metal-coated steel strip according to item [1] or [2], in which each of the paired gas wiping nozzles has a nozzle header and an upper nozzle member and a lower nozzle member which are connected to the nozzle header, in which, in a cross-sectional view in a direction perpendicular to the width direction of the steel strip, front edge portions of the upper nozzle member and the lower nozzle member are parallel to and face each other to form the gas injection port, and in which the gas is passed through the nozzle header and injected through the gas injection port.

[4] The method for manufacturing a hot-dip metal-coated steel strip according to item [3], in which an internal pressure of the nozzle header is 2 kPa to 70 kPa.

[5] The method for manufacturing a hot-dip metal-coated steel strip according to any one of items [1] to [4], in which baffle plates are placed between the paired gas wiping nozzles so as to face the gas injection ports on outsides of both edges in the width direction of the steel strip.

According to aspects of the present invention, it is possible to inhibit splash from adhering to a steel strip, thereby manufacturing a hot-dip metal-coated steel strip in which a splash defect is inhibited from occurring.

According to aspects of the present invention, by operating gas wiping nozzles in a predetermined range with respect to the passing direction of a steel strip, it is possible to limit the scattering direction of splash. As a result, it is possible to inhibit a splash defect from occurring, and it is possible to stably manufacture a hot-dip metal-coated steel strip having excellent surface quality.

DETAILED DESCRIPTION OF EMBODIMENTS OF THE INVENTION

Hereafter, embodiments of the present invention will be described with reference to the figures. The embodiments described below exemplify apparatuses and methods to give a concrete form to the technical idea according to aspects of the present invention, and the present invention is not limited to the embodiments described below.

In addition, the figures are schematic. Therefore, it should be noted that the relationships, ratios, and the like regarding the thickness and the plane dimensions are different from actual ones, and some parts also vary in dimensions or ratios between figures.

Figure 1:
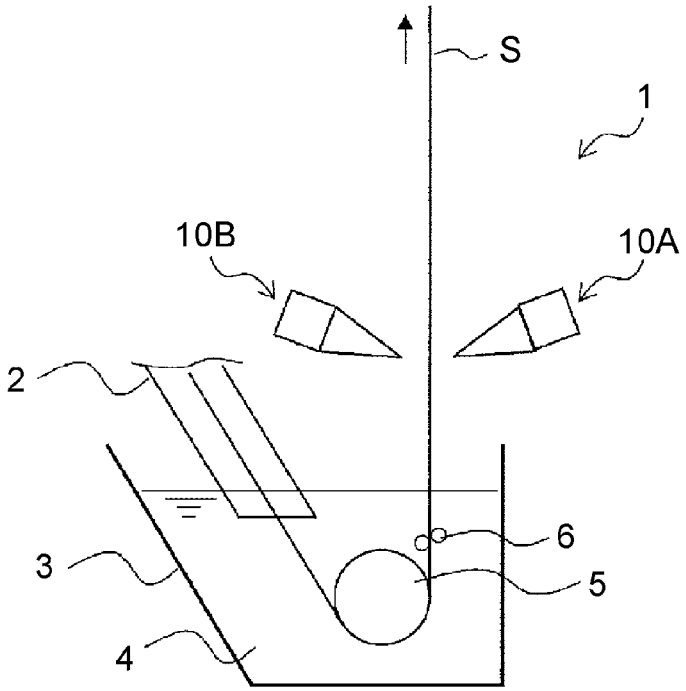
FIG. 1 is a schematic diagram illustrating an overall configuration of continuous hot-dip metal coating equipment having gas wiping nozzles according to one embodiment of the present invention.

FIG. 1 is a schematic diagram illustrating the overall configuration of the continuous hot-dip metal coating equipment having gas wiping nozzles according to one embodiment of the present invention.

The continuous hot-dip metal coating equipment 1 illustrated in FIG. 1 is equipment in which, after a molten metal is caused to continuously adhere to the surface of a steel strip S that is a metal strip by dipping the steel strip S in a molten metal bath 4 formed of the molten metal, the adhesion amount of the molten metal is controlled to a predetermined value.

The continuous hot-dip metal coating equipment 1 has a snout 2, a coating tank 3, a sink roll 5, and support rolls 6.

The snout 2 is a member which defines a space through which the steel strip S is passed. The snout 2 is a member having a rectangular cross section in a direction perpendicular to the passing direction of the steel strip S and has an upper end connected to, for example, the exit of a continuous annealing furnace and a lower end immersed in the molten metal bath 4 contained in the coating tank 3. In the present embodiment, the steel strip S annealed in a continuous annealing furnace in a reducing atmosphere is passed through the snout 2 and continuously fed into the molten metal bath 4 in the coating tank 3. Subsequently, the steel strip S is pulled up above the molten metal bath 4 from the bath via the sink roll 5 and the support rolls 6 which are placed in the molten metal bath 4.

Then, a gas (wiping gas) is injected onto both the front and back surfaces of the steel strip S, which has been pulled up above the molten metal bath 4 from the bath, through paired gas wiping nozzles 10A and 10B which are arranged on both the front and back surface sides of the steel strip S (through a gas injection port 11 described below) to adjust the adhesion amount of the molten metal on both surfaces of the steel strip S. Subsequently, the steel strip S is cooled by using cooling equipment which is not illustrated and is then passed to subsequent processes so as to be continuously formed into a hot-dip metal-coated steel strip.

Figure 2:
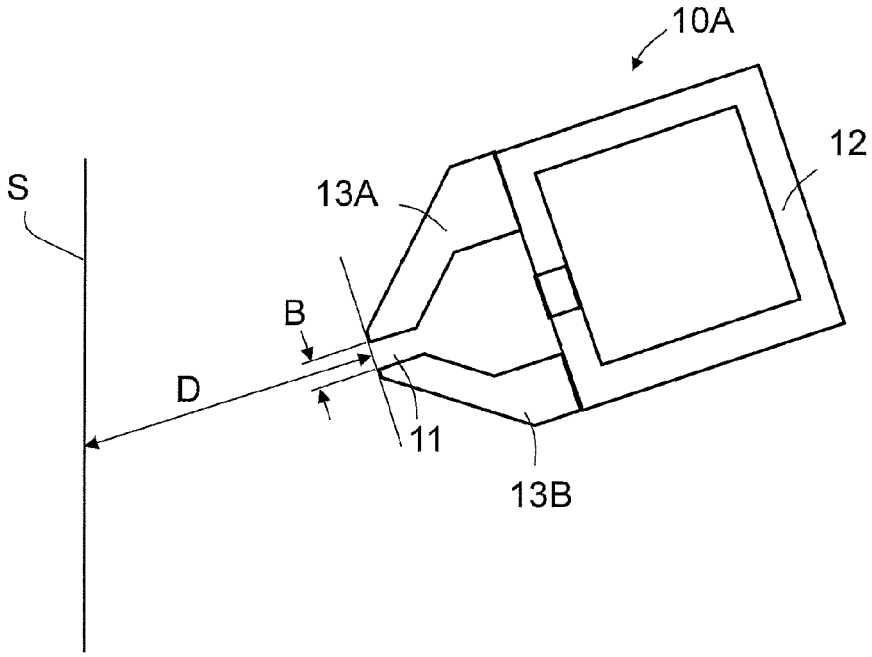
FIG. 2 is a schematic diagram illustrating an overall configuration of the gas wiping nozzle used in the continuous hot-dip metal coating equipment illustrated in FIG. 1.

The paired gas wiping nozzles 10A and 10B (hereinafter, also simply referred to as "nozzle" or "nozzles") are arranged above the molten metal bath 4 in such a manner that the nozzles 10A and 10B face each other across the steel strip S. As illustrated in FIG. 2, the nozzle 10A injects a gas through a gas injection port 11 (nozzle slit), which is placed at the front edge of the nozzle 10A such that the nozzle slit extends in the width direction of the steel strip, onto the steel strip S to adjust the coating weight on the surface of the steel strip. The nozzle 10B on the other side works as in the case of the nozzle 10A. Since excess molten metal is blown off by using the paired nozzles 10A and 10B, the coating weight on both the surfaces of the steel strip S is adjusted and is made uniform in the width direction and the longitudinal direction thereof.

Since the nozzle 10A is usually constructed to have a width wider than the width of the steel strip to be coated so as to be effective over a wide range of steel strip widths and so as to respond to the positional shift in the width direction of the steel strip and the like occurring when the steel strip is pulled up, the nozzle extends beyond the edges in the width direction of the steel strip. In addition, as illustrated in FIG. 2, the nozzle 10A has a nozzle header 12 and an upper nozzle member 13A and a lower nozzle member 13B which are connected to the nozzle header 12. In a cross-sectional view in a direction perpendicular to the width direction of the steel strip S, the front edge portions of the upper and lower nozzle members 13A and 13B are parallel to and face each other to form the gas injection port 11 (nozzle slit) (parallel portion in FIG. 2). The gas injection port 11 extends in the width direction of the steel strip S. Specifically, the gas injection port 11 has a slit-like shape extending in the width direction of the steel strip S to a range wider than the width of the steel strip S. In addition, the longitudinal section of the nozzle 10A has a tapered shape narrowing toward its front edge. The thickness of the front edge portions of the upper and lower nozzle members 13A and 13B (refer to thickness P in FIG. 15) may be about 1 mm to 3 mm. In addition, although there is no particular limitation on the width of the gas injection port (opening width) B (slit gap), the slit gap may be about 0.5 mm to 3.0 mm. A gas supplied from a gas supplying system which is not illustrated is passed through the nozzle header 12, passed through a gas flow channel defined by the upper and lower nozzle members 13A and 13B, and injected through the gas injection port 11 so as to be injected onto the surface of the steel strip S. The nozzle 10B on the other side has a similar configuration. In this case, the internal pressure of the nozzle header 12 is measured by using a pressure meter, which is not illustrated. The internal pressure of the nozzle header 12 may be adjusted in accordance with the output from the gas supplying system.

Figure 15:
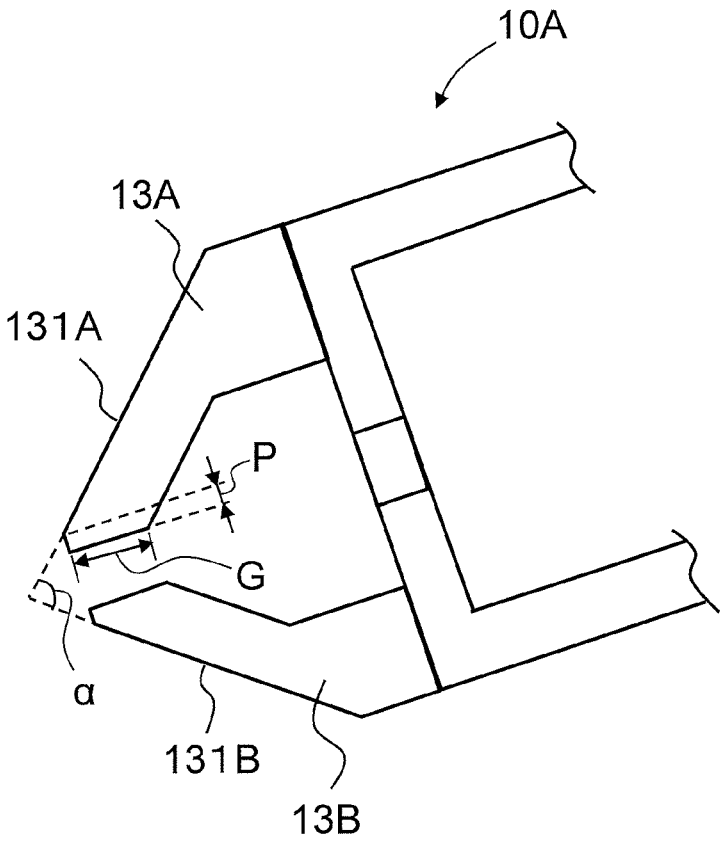
FIG. 15 is an enlarged view of a portion in the vicinity of a front edge of the gas wiping nozzle.

FIG. 15 is an enlarged view of a portion in the vicinity of the front edge of the nozzle 10A. As illustrated in FIG. 15, the tapered portion on the external side of the upper nozzle member 13A is called the external tapered portion of the upper nozzle member 13A (external tapered portion 131A), the tapered portion on the external side of the lower nozzle member 13B is called the external tapered portion of the lower nozzle member 13B (external tapered portion 131B). In addition, the angle between the external tapered portion 131A of upper nozzle member 13A and the external tapered portion 131B of the lower nozzle member 13B is called the external angle of the nozzle 10A (external angle $\alpha$).

Here, when the hot-dip metal-coated steel strip is manufactured, a pressurized gas is injected through the gas wiping nozzles, which are arranged on both the front and back surface sides of the steel strip so as to face each other across the steel strip, onto the surfaces of a steel strip, which is continuously pulled up from the molten metal coating bath, to control the thickness of the adhered metal. At this time, there is a problem in that the molten metal scatters and that the scattered molten metal solidifies and forms metal powder (splash) which adheres to the steel strip and causes a deterioration in the surface quality of the steel strip.

Figure 3:
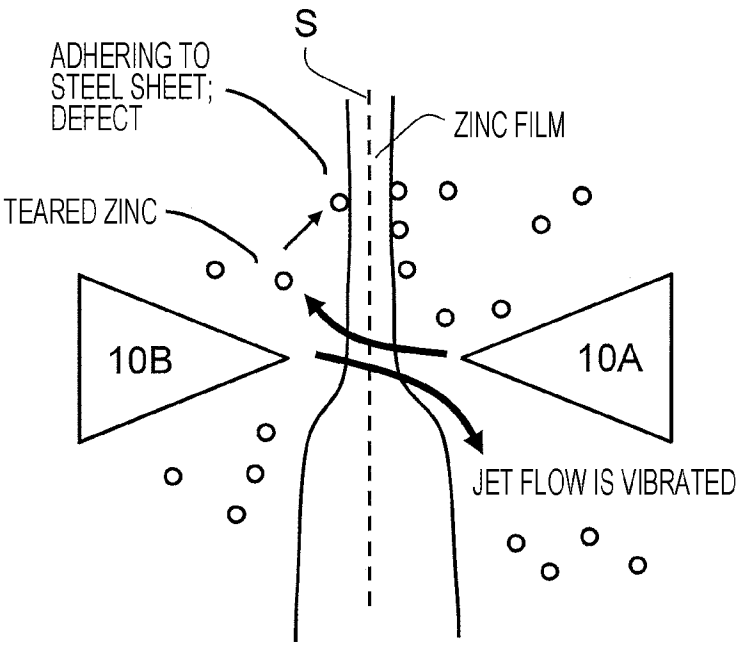
FIG. 3 is a schematic diagram illustrating a scattering direction of splash.
Figure 3:
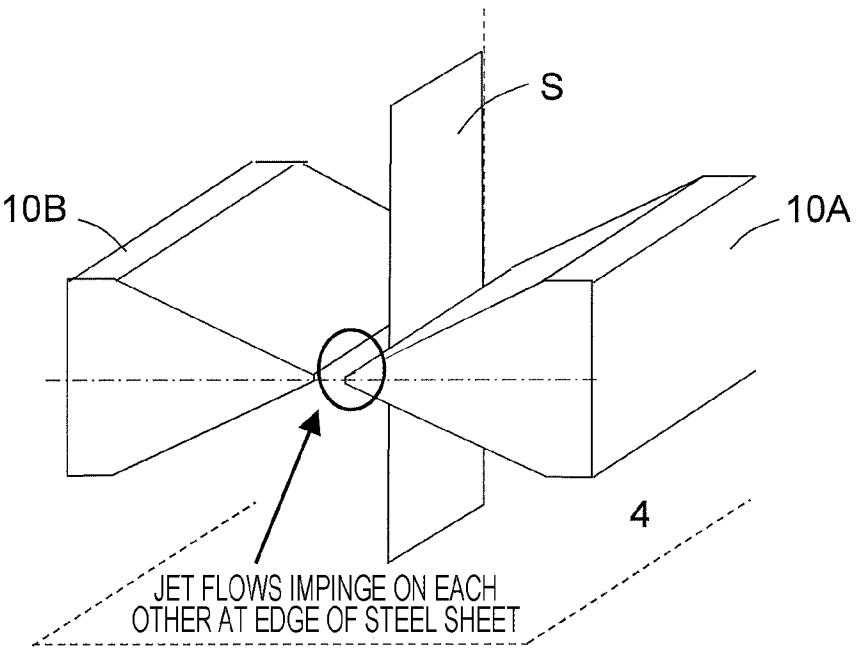

Here, the term "splash defect" denotes a defect caused by splash adhering to a steel sheet. Specifically, as illustrated in FIG. 3(*a*), jet flows (gas jet flows) injected through the nozzles facing each other are vibrated due to the jet flows impinging on each other in the vicinity of the edge of the steel sheet, the liquid film of the molten metal is teared due to such vibration, the teared liquid film scatters in the form of droplets, the scattered droplets are solidified (and form metal powder), and the metal powder adheres to the steel sheet to causes such a defect.

When considering a method for inhibiting a splash defect, the present inventors first investigated the scattering direction of splash (metal powder) by using a high-speed camera. As a result, it was found that, in the case where the nozzle angle θ (angle between the gas injection direction and the horizontal plane) is 0°, which is a typical operation condition applied for a CGL (continuous galvanizing line), as illustrated in FIG. 3 (*b*), splash scatters widely above and below the nozzle. To inhibit the splash defect, operators make a fine adjustment on an empirical basis by tilting a nozzle downward (nozzle angle: 0° to 2°). However, since the fine adjustment of the nozzle angle depends on the skill level of the operators, there is a variation in the degree of a splash defect in accordance with the timing of an operation, that is, splash defects occur inconsistently. Therefore, it was considered that, in the case where the nozzle is tilted downward at a large angle, there may be an improvement in splash defect due to a significant change in conditions.

Figure 4:
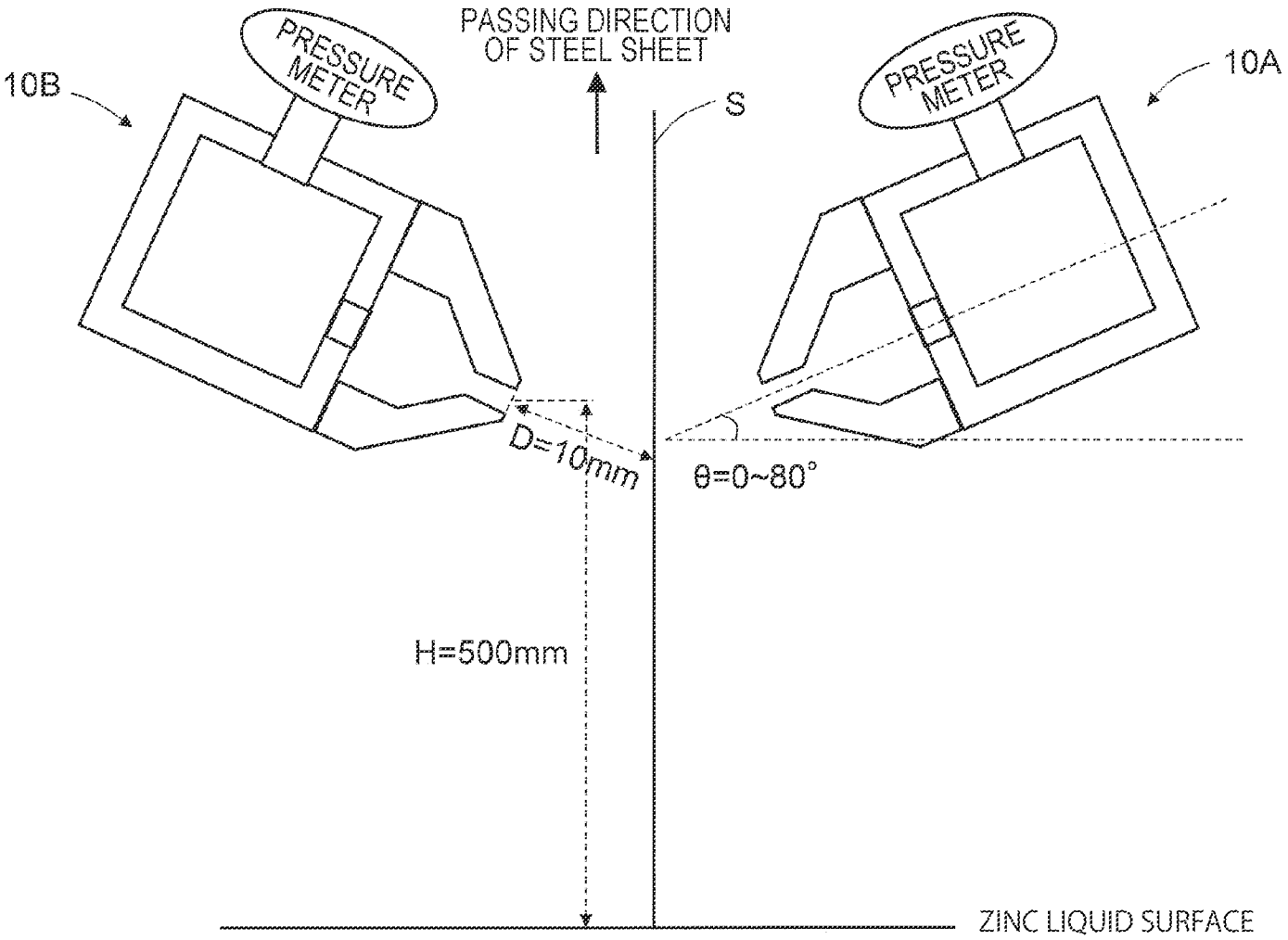
FIG. 4 is a schematic diagram illustrating a configuration according to one embodiment of the present invention.
Figure 5:
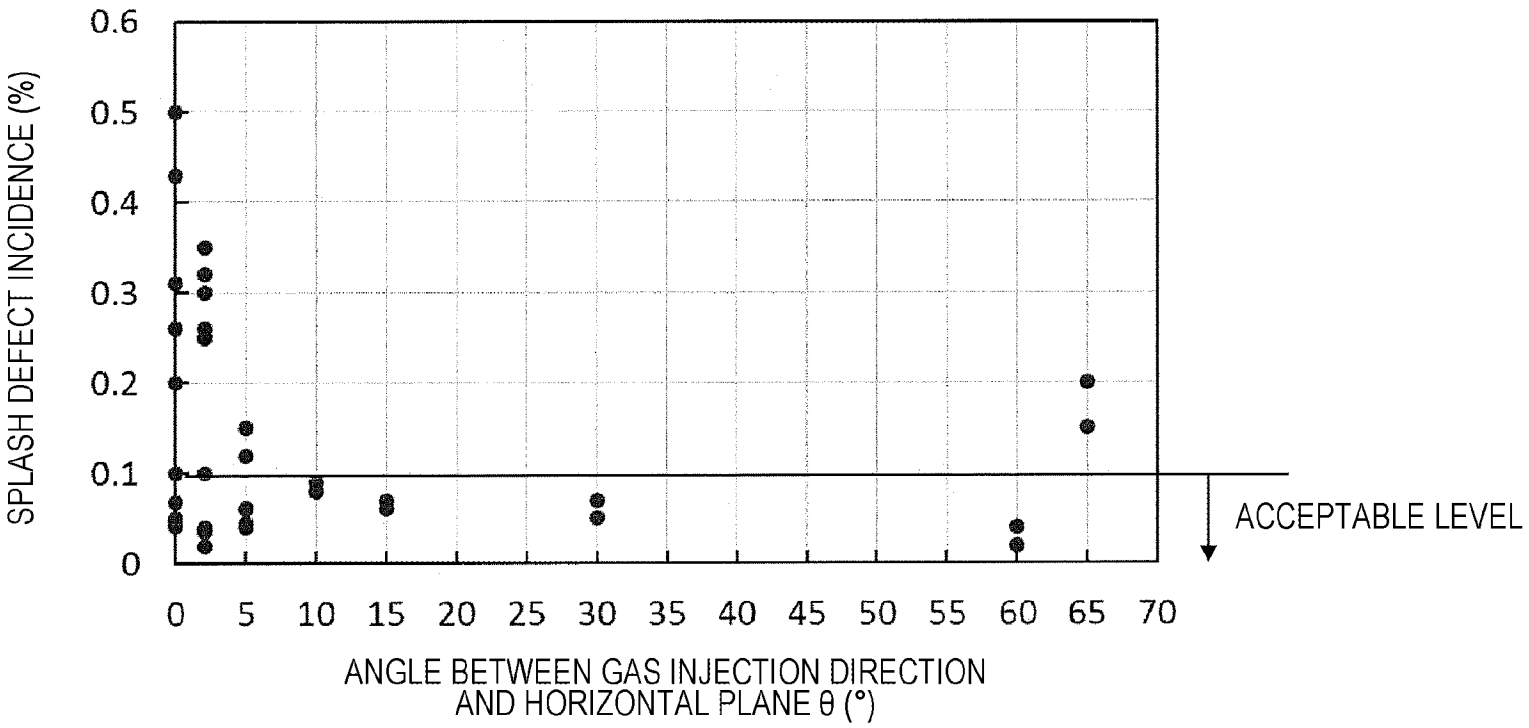
FIG. 5 is a graph illustrating investigation results regarding an angle θ between a gas injection direction and a horizontal plane and a splash defect incidence in one embodiment of the present invention.

In a practical CGL, a coil having a width of 1000 mm, a thickness of 1 mm, and a weight of 10 tons was passed at a speed of 100 mpm (meters per minute). At that time, as illustrated in FIG. 4, under the conditions of a distance between the nozzle and the steel sheet of 10 mm, a nozzle angle θ of 0° to 80°, and a nozzle tip height of 500 mm, the pressure which is indicated by a pressure meter fitted to the nozzle header was adjusted so that the adhesion amount of zinc at the central position in the width direction of the steel sheet was (50±5) g/m$^2$. Subsequently, the splash defect incidence was investigated by using a defect meter placed at the exit of the CGL, and the correlation between the splash defect incidence and the nozzle angle was investigated. Here, the term "splash defect incidence" denotes the ratio of the length of the portion of the steel strip which was judged as to have a splash defect in the inspection process with respect to the length of the steel strip which had been passed through the line. In addition, the slit gap B (the width of the gas injection port) was 1.0 mm. The experimental results are shown in FIG. 5. Here, each dot in the graph corresponds to one coil, and the acceptance criterion for the splash defect incidence was set to be 0.10% or less. This is because a steel strip having a splash defect incidence of 0.10% or less is regarded as having a quality sufficient for a steel strip to be used for automobiles and the like which is required to meet a strict standard of surface quality.

In FIG. 5, there is a significant variation in splash defect incidence in the case where the nozzle angle θ is close to 0°. This indicates that it is difficult to control a splash defect by making a fine adjustment to the nozzle angle. The splash defect incidence decreased as the nozzle was increasingly tilted downward, that is, with an increase in nozzle angle. In addition, the splash defect incidence increased again in the case where θ was more than 60°.

Figure 6:
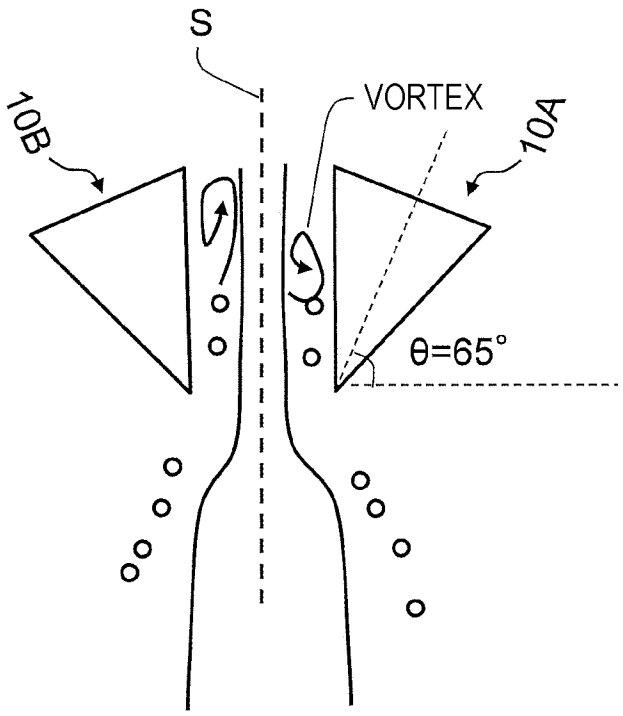
FIG. 6 is a schematic diagram illustrating the scattering direction of splash in the case of θ being 30° and in the case of θ being 65° in one embodiment of the present invention.
Figure 6:
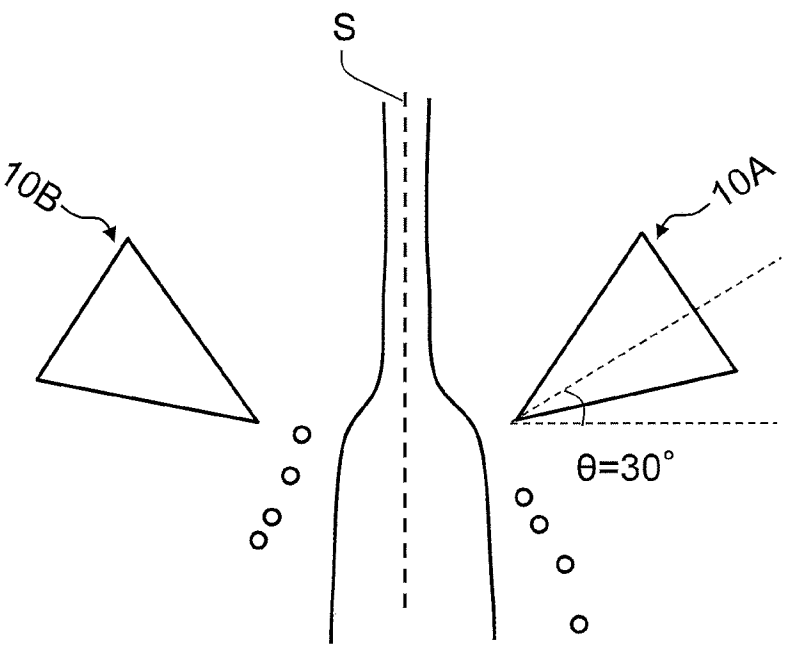

FIG. 6 illustrates the results obtained by observing the state of splash scattering, by using a high-speed camera. It was found that, in the case of a nozzle angle θ of 30° where the splash defect incidence was low, splash flew only downward below the nozzles, and that, in the case of a nozzle angle θ of 65° where the splash defect incidence started increasing, splash flew toward both above and below the nozzles.

The reasons for this are considered to be as follows. In the case of a nozzle angle θ of 0°, as illustrated in FIG. 3, the flows of the gas injected through the nozzles facing each other impinge on each other in the vicinity of the edge of the steel sheet. Since there is a slight difference in nozzle pressure between the nozzles, and since there is also a variation in nozzle pressure over time, the jet flows impinging on each other in the vicinity of the edge of the steel sheet flow both toward above and below the nozzles. Consequently, it is presumed that splash flies upward and downward.

Also in the case where the nozzle angle is large, that is, in the case where the nozzle is tilted downward at a large angle, the jet flows impinge on each other in the vicinity of the edge of the steel sheet. However, it is considered that, since the amount of the gas flowing toward the bath surface, i.e., the liquid surface of the molten metal bath (downward) is larger than that of the gas flowing upward, splash flies downward dominantly, which results in splash being inhibited from flying upward above the nozzles. It is presumed that, since there is a decrease in the range in which splash scatters for this reason, there is a decrease in splash defect incidence. Similarly, it is considered that, in the case where the nozzle angle θ is 10° to 60°, almost no splash flies upward above the nozzles, which results in the splash defect incidence being close to 0. By performing an operation in such a range, since splash is inhibited from flying upward above the nozzles, it is also possible to inhibit an operation problem, in which splash adheres to the gas injection port to cause nozzle clogging, from occurring.

It is considered that, in the case where the nozzle angle θ is more than 60°, as illustrated in FIG. 6, since there is a decrease in gap width between the nozzle and the steel sheet, it is difficult for air to pass upward through the gap, which results in vortices being generated. That is, since there is a decrease in gap width between the external tapered portion of the upper nozzle member 13A and the steel strip S, the flow of the gas which flows upward after having impinged on the steel sheet in the vicinity of the edge of the steel sheet is disturbed, which results in a tendency for vortices to be generated between the external tapered portion and the steel strip S. In this case, splash scattering from the edge of the steel sheet flies in various directions due to the generated vortices. The reason for the increase in splash defect incidence is considered that splash which flew upward above the nozzle due to such vortices adhere to the steel sheet.

Regarding the nozzle angle θ, since there is an effect of decreasing the splash defect incidence in the case where θ is 10° or more, the lower limit of θ is set to be 10°. Here, the adhesion amount of zinc varies in accordance with the impingement pressure gradient due to the impinging of the gas against the steel strip S and with the shear force generated in the zinc film due to the impinging of the gas against the steel strip S, and impingement pressure gradient decreases with an increase in the nozzle angle of the nozzle tilting downward. Here, the term "impingement pressure gradient" denotes the gradient of the impingement pressure in a direction corresponding to the direction of the slit gap B when the jet flow injected through the nozzle impinges on the target (steel strip). Here, to achieve a certain adhesion amount of zinc with a certain distance (gap) between the nozzle and the steel sheet, there is an increase in gas flow rate necessary. Therefore, a compressor having a large capacity is necessary, which results in an increase in construction cost. In addition, as described above, in the case where vortices are generated between the external tapered portion of the upper nozzle member and the steel sheet, since a splash defect is induced, it is not possible to control to inhibit splash. Moreover, the external angle (external angle α in FIG. 15) of the nozzle is set to be about 40° to 50° in consideration of the rigidity of the nozzle. In the case where the nozzle is tilted at an angle of 70° or more, since (70°+20° (half the external angle)) equals 90°, the nozzle comes into contact with the steel sheet. Also in consideration of the distance between the nozzle and the steel sheet, the practical upper limit of the nozzle angle θ is about 60°. In addition, there is an effect of decreasing the splash defect incidence in the case where the nozzle angle θ is 60° or less. For the reasons described above, the upper limit of the nozzle angle θ is set to be 60°.

The optimum range of the nozzle angle θ is expressed by the expression 15°≤θ≤45°. The effect of decreasing the splash defect incidence is achieved in the case where the nozzle angle θ is 10° or more, and, in the case where the nozzle angle θ is 15° or more, there is an increased possibility of inhibiting a decrease in the impinging pressure in the vicinity of the edge of the steel sheet. That is, in the case where the nozzle angle θ is small, as a result of jet flows injected through the nozzles facing each other impinging on each other beyond the edge of the steel sheet, the jet flows are vibrated, which results in a decrease in pressure placed on the edge of the steel sheet. In contrast, in the case where the nozzle angle θ is 15° or more, it is possible to inhibit a decrease in pressure placed on the edge of the steel sheet. In the case where there is a decrease in pressure placed on the edge of the steel sheet, there is a decrease in the effect of blowing off the excess of the molten metal. In the case where the nozzle angle θ is 15° or more, it is possible to inhibit an edge overcoat defect, which is caused by an excessive adhesion amount at the edge of the steel sheet. Therefore, the lower limit of the optimum range of the nozzle angle θ is set to be 15°. In the case where the nozzle angle θ is more than 45°, since there is an increase in the amount of the gas flowing toward the bath surface, there is a risk of zinc splash scattering from the bath surface. Therefore, the upper limit of the optimum range of the nozzle angle θ is set to be 45°. Here, the phenomenon in which the zinc splash scatters from the bath surface is called "liquid-surface splash". In the case where the liquid-surface splash occurs, there may be problems of defects occurring in the steel sheet and a deterioration in the environment in the vicinity of the equipment.

Figure 7:
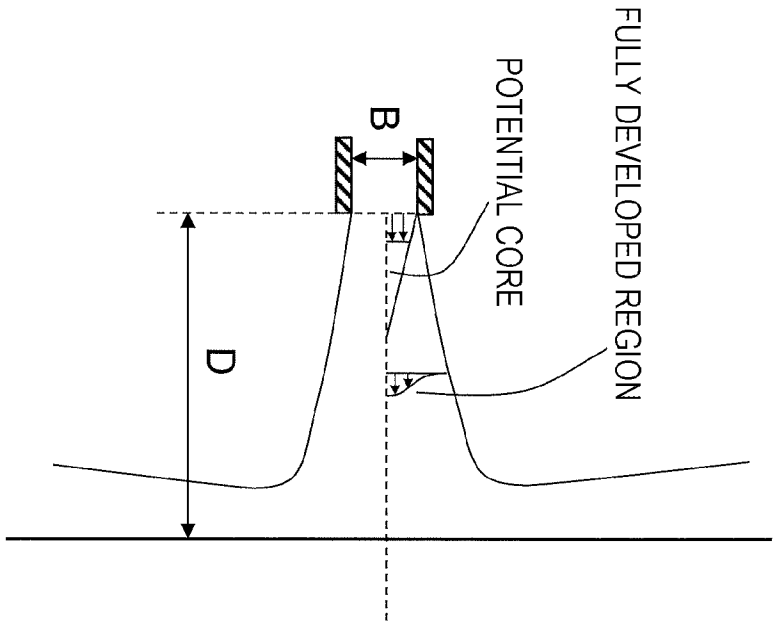
FIG. 7 is a schematic diagram illustrating a speed distribution of a jet flow injected through the gas wiping nozzle.

As described in FIG. 7, it is possible to organize the characteristics of the impinging jet flow in accordance with the ratio D/B of a distance (gap) D between the front edge of the nozzle (front edge of the gas injection port) and the impinging plate (steel strip) to the slit gap B. In a region in which D/B is small, an average jet flow speed on the jet flow axis is equal to that at the exit of the injection port, and such a region is called a "potential core". Subsequently, as D/B increases, turbulence at the outer edge of the jet flow reaches the jet flow axis, there is a decrease in speed on the jet flow axis, and the potential core is eliminated to form a fully developed region, in which the jet flow is fully disturbed. The present inventors considered that the variation in the impingement pressure of the gas flows injected through the nozzles facing each other in the vicinity of the edge of the steel sheet is influenced by the turbulence of the jet flow due to the elimination of the potential core. Therefore, the relationship between the splash defect incidence and the nozzle angle was investigated for various values of D/B in the case of nozzle angle θ being 10°, in the case of nozzle angle θ being 15°, and in the case of nozzle angle θ being 30°. The results are shown in FIGS. 8 to 10.

Figure 8:
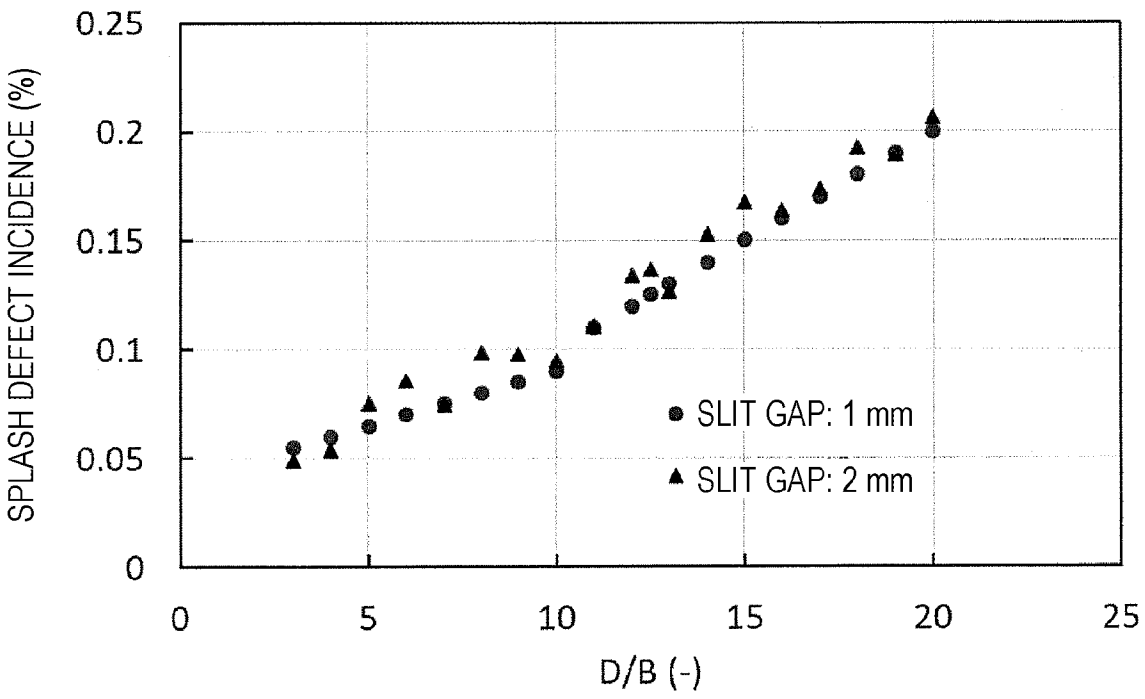
FIG. 8 is a graph illustrating investigation results regarding the splash defect incidence in the case of θ being 10° for slit gaps of 1 mm and 2 mm.
Figure 9:
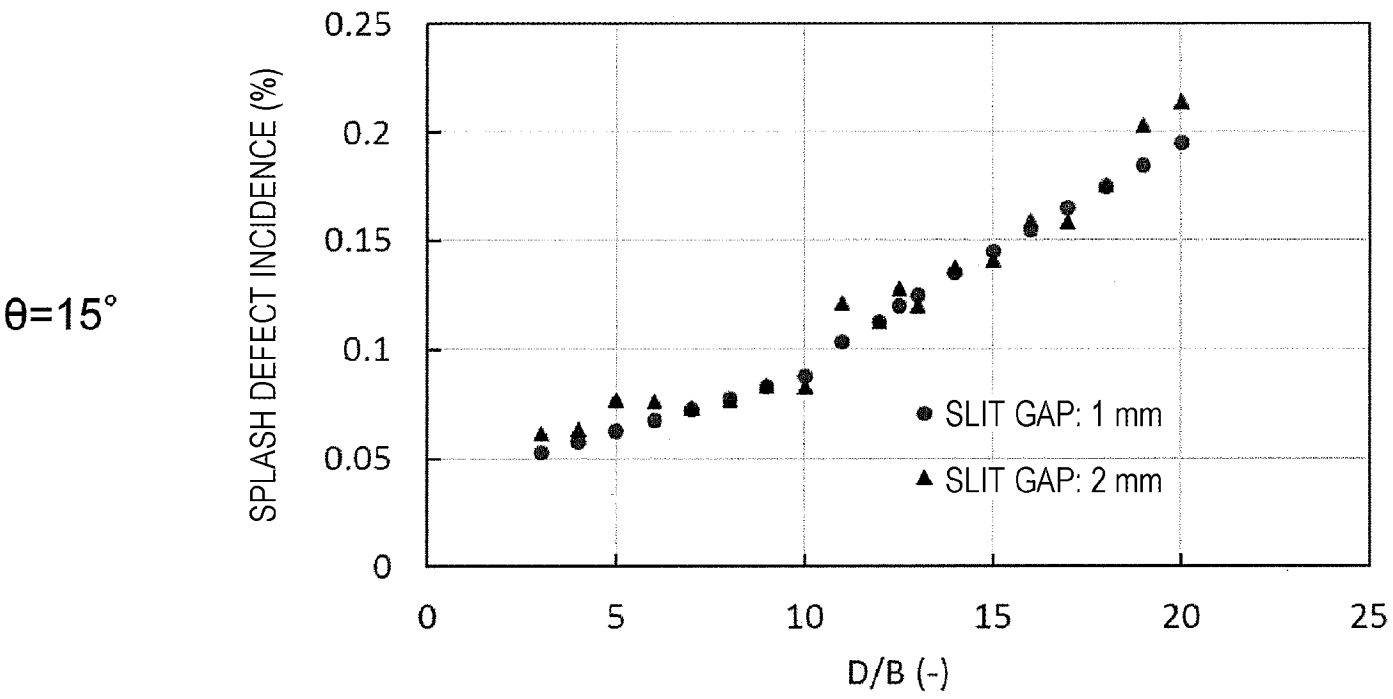
FIG. 9 is a graph illustrating investigation results regarding the splash defect incidence in the case of θ being 15° for slit gaps of 1 mm and 2 mm.
Figure 10:
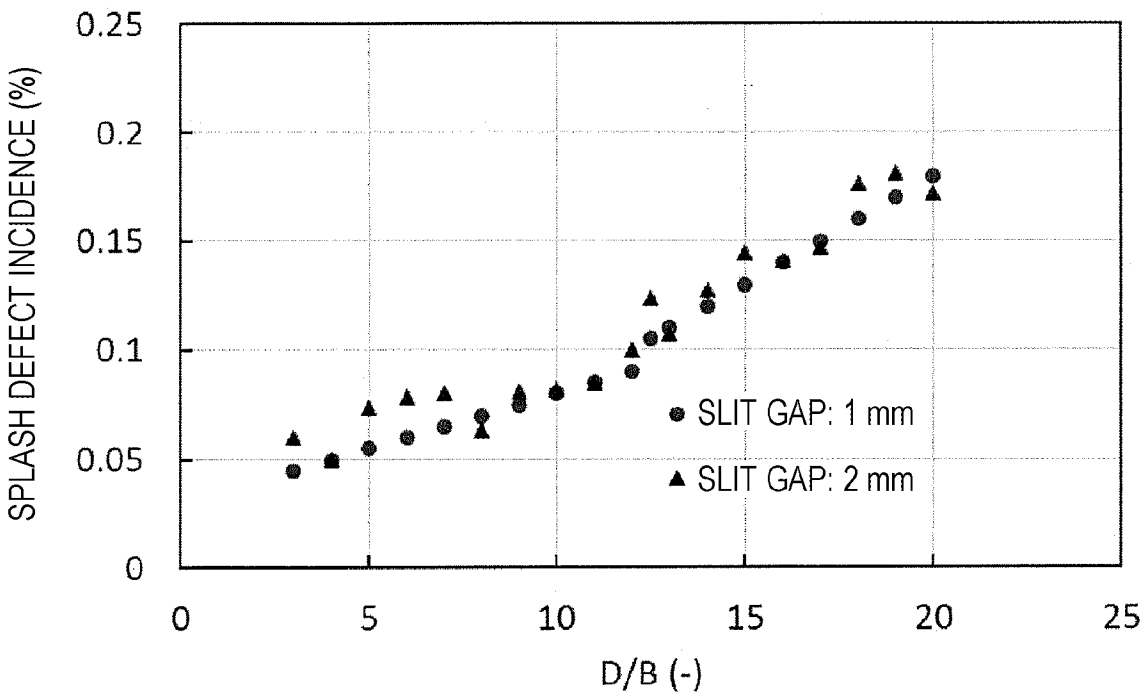
FIG. 10 is a graph illustrating investigation results regarding the splash defect incidence in the case of θ being 30° for slit gaps of 1 mm and 2 mm.

As indicated in FIGS. 8 to 10, it is clarified that, in the case where the nozzle angle is constant, the splash defect incidence is organized in accordance with D/B regardless of the slit gap B. In addition, the splash defect incidence varies in accordance with the nozzle angle. From these results, it was found that, to inhibit a splash defect, controlling the ratio D/B of the nozzle-steel sheet distance to the slit gap and the nozzle angle is important.

Since there is a risk that the nozzle impinges on the steel sheet due to the warpage of the steel sheet in the case where the nozzle-steel sheet distance is small, the lower limit of D/B is set to be 3. In the case where D/B is large, since there is an increase in the degree of the turbulence of the jet flow (deterioration in the stability of the jet flow) due to the elimination of a potential core, there is also an increase in splash defect incidence. Therefore, in the case of a nozzle angle θ of 10°, the upper limit of D/B is set to be 10 (FIG. 8). In the case where there is an increase in the nozzle angle θ, splash is inhibited from flying upward in the vicinity of the edge of the steel sheet. Therefore, there is an increase in the range of D/B in which it is possible to perform an operation with a splash defect being inhibited, and the upper limit of D/B is set to be 12 in the case of a nozzle angle θ of 30° (FIG. 10). In the case where θ is 10° or more and 30° or less, it is possible to perform an operation with a splash defect being inhibited in a range expressed by a straight line connecting the points corresponding to the upper limits of D/B in the case of a nozzle angle θ of 10° and in the case of a nozzle angle θ of 30°. In the case where D/B is more than 12, even if the nozzle angle θ is increased, since the effect of an increase in the instability of the jet flow is dominant, it is not possible to achieve the effect of decreasing the splash defect incidence. Therefore, in the case where θ is 30° or more and 60° or less, the upper limit of D/B is set to be 12.

Figure 11:
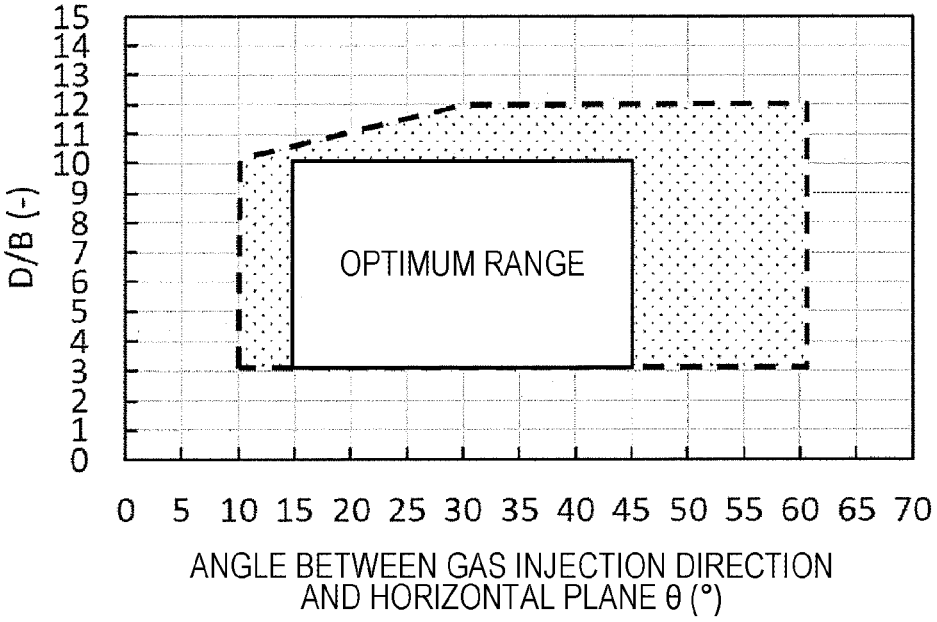
FIG. 11 is a diagram illustrating a range represented by the angle θ (°) between the gas injection direction and the horizontal plane and the ratio D/B of a distance D (mm) between a front edge of a gas injection port and a steel strip to a width B (mm) of the gas injection port in accordance with aspects of the present invention.

The above-described conditions regarding the nozzle angle θ and D/B under which it is possible to perform an operation with a splash defect being inhibited are summarized in the form of (equation 1) to (equation 5). The above-described range regarding D/B and θ is summarized and illustrated in FIG. 11.

$$D/B = 3 \quad \text{(equation 1)}$$

$$D/B = 0.1 \times \theta + 9 \quad \text{(equation 2)}$$

$$D/B = 12 \quad \text{(equation 3)}$$

$$\theta = 10 \quad \text{(equation 4)}$$

$$\theta = 60 \quad \text{(equation 5)}$$

The optimum range of D/B is expressed by the expression D/B≤10. In the case where D/B is 10 or less, since it is possible to inhibit a decrease in impingement pressure placed on the edge of the steel sheet due to the jet flows injected through the nozzles facing each other impinging on each other beyond the edge of the steel sheet, it is possible to inhibit an edge overcoat defect. That is, in the case where D/B is increased, since there is an increase in the degree of the turbulence of the jet flow due to the elimination of a potential core, there is also an increase in the degree of vibration of the jet flows which occurs when the jet flows injected through the nozzles facing each other impinge on each other beyond the edge in the width direction of the steel sheet. To inhibit a decrease in the impingement pressure placed on the edge in the width direction of the steel sheet due to such an increase in the degree of vibration, it is preferable that D/B be within the range described above.

Under the conditions where the nozzle angle θ and the ratio D/B of the nozzle-steel sheet distance to the slit gap are within the above-described optimum range for preventing a splash defect, it is preferable that the internal pressure (gas pressure) of the nozzle header 12 be 2 kPa to 70 kPa. It is more preferable that such a pressure be 3 kPa or higher. In addition, it is more preferable that such a pressure be 60 kPa or lower. This is because, in the case where the internal pressure of the nozzle header 12 is lower than 2 kPa, since there is an increase in the degree of the turbulence of the jet flow before impinging on the steel sheet, a splash defect tends to occur. This is because, in the case where the internal pressure of the nozzle header 12 is higher than 70 kPa, since there is an increase in the size of a compressor for injecting the gas, there is an increase in equipment costs, which is uneconomical.

In addition, under the conditions where the nozzle angle θ and D/B are within the optimum range described above, it is preferable that the jet flow speed of the gas injected through the nozzle (gas flow speed at the front edge of the nozzle) be 100 m/s to 500 m/s. This is because, in the case where the flow speed of the gas injected through the nozzle is lower than 100 m/s, since there is an increase in the degree of the turbulence of the jet flow before impinging on the steel sheet, a splash defect tends to occur. This is because, in the case where the flow speed of the gas injected through the nozzle is higher than 500 m/s, since there is an increase in the size of a compressor for injecting the gas, there is an increase in equipment costs, which is uneconomical.

Moreover, it is preferable that the length of the parallel part of the slit gap formed in the gas injection port 11 (length G in FIG. 15) be 10 mm to 40 mm. This is because, in the case where the length of the parallel part of the slit gap is less than 10 mm, since there is an insufficient potential core formed in the injected jet flow, there is an increase in the degree of the turbulence of the jet flow before impinging on the steel sheet, which results in a tendency for a splash defect to occur. This is because, in the case where the length of the parallel part of the slit gap is more than 40 mm, since there is an increase in resistance to the flow of the gas passing through the slit gap, there is a decrease in the efficiency of the gas injection, which results in an excessive increase in driving power necessary.

In addition, in the case where a nozzle tip height, which is defined as a distance between the front edge of the nozzle (front edge of the gas injection port) and the liquid surface of the molten metal (zinc) bath, is excessively small, since vortices are generated between the nozzle and the liquid surface of the molten metal (zinc) bath, a bath wrinkle defect occurs. That is, bath wrinkles are generated due to the flow (back flow) of the molten metal, which is the flow of the hot metal that has been blown off by the gas injected through the nozzle and flows down along the surface of the steel sheet, being nonuniform. To the contrary, in the case where the nozzle tip height is excessively large, since local solidification of the metal (zinc) starts before the wiping gas is injected onto the steel strip after the steel strip has been pulled up from the molten metal bath, a bath wrinkle defect occurs due to such solidification. That is, since the viscosity of zinc on the surface of the steel sheet becomes nonuniform due to the local solidification of zinc, bath wrinkles are generated. Therefore, to inhibit a bath wrinkle defect, it is preferable that the nozzle tip height H (distance between the front edge of the gas injection port and the liquid surface of the molten metal bath, refer to FIG. 4) be 50 mm or more and 700 mm or less. Here, it is more preferable that the nozzle tip height H be more than 150 mm (H>150 mm). In addition, it is more preferable that the nozzle tip height H be less than 550 mm (H<550 mm).

The term "bath wrinkles" denotes a wave-like pattern (wrinkles) generated on the surface of the coating layer of a hot-dip metal-coated steel sheet. In the case where a coated steel sheet having bath wrinkles is used as an exterior plate, when the surface of the coating layer is used as a base surface for painting, there is a deterioration in the surface quality of the paint film and, in particular, smoothness.

Next, when the steel strip S is manufactured, it is preferable that the temperature of the wiping gas be controlled so that the temperature T (° C.) of the gas (wiping gas) immediately after having been injected through the nozzle slit of the gas wiping nozzle 10 satisfies the relational expression $TM-150 \leq T \leq TM+250$ in relation to the melting point TM (° C.) of the molten metal. By controlling the temperature T (° C.) of the wiping gas to be within such a range, since it is possible to inhibit cooling and solidification of the molten metal, a variation in viscosity is less likely to occur, which results in a bath wrinkle defect being inhibited from occurring. On the other hand, in the case where the temperature T (° C.) of the wiping gas is lower than TM−150° C., since the fluidity of the molten metal is not affected, there is no effect of inhibiting a bath wrinkle defect from occurring. In addition, in the case where the temperature T (° C.) of the wiping gas is higher than TM+250° C., since alloying is promoted, there is a deterioration in surface appearance of the steel sheet.

In addition, there is no particular limitation on the method used for heating the wiping gas, which is supplied to the gas wiping nozzle 10. Examples of such a method include a method in which the gas is supplied after having been heated by using a heat exchanger and a method in which the annealing exhaust gas of the annealing furnace and air are mixed.

Figure 12:
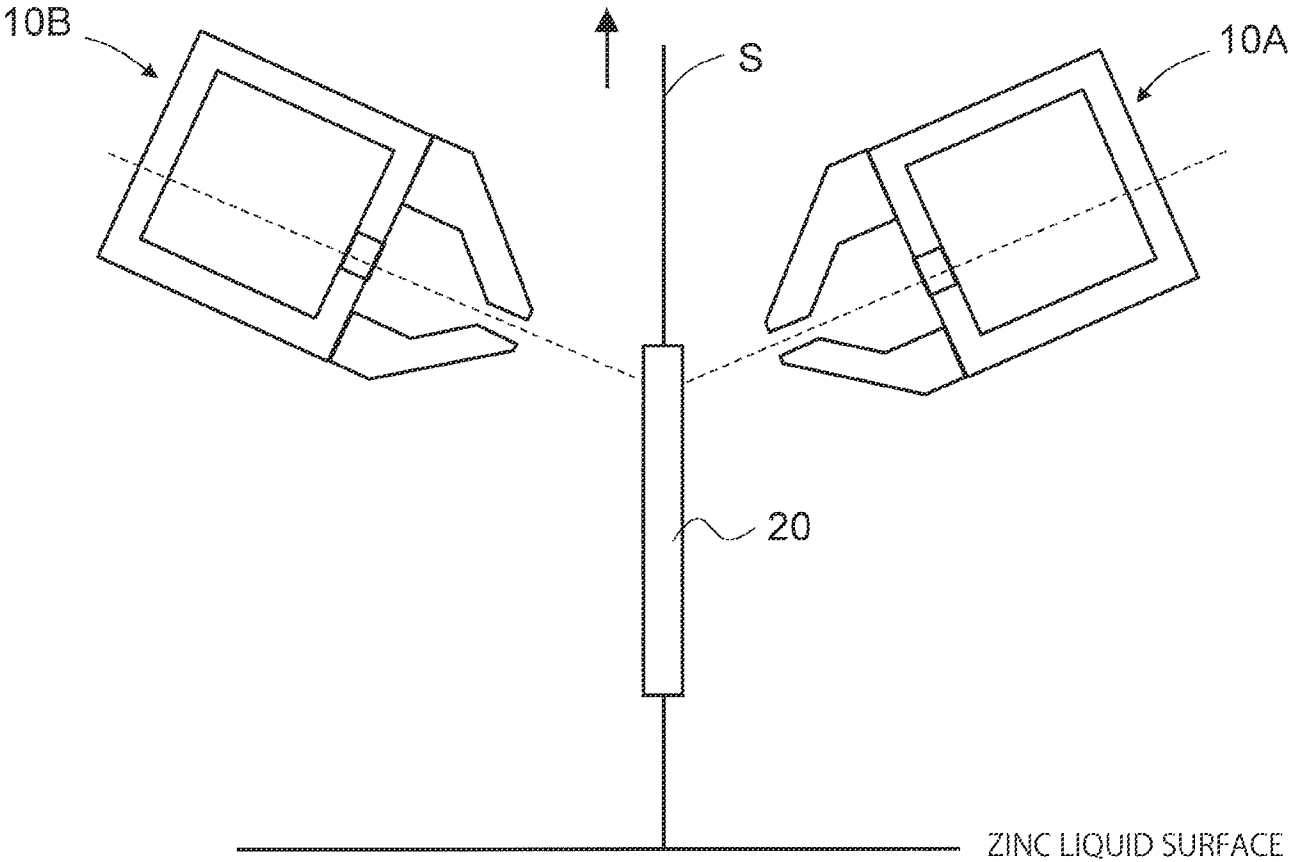
FIG. 12 is a schematic diagram (side view) illustrating one embodiment of a case where a baffle plate is placed.
Figure 13:
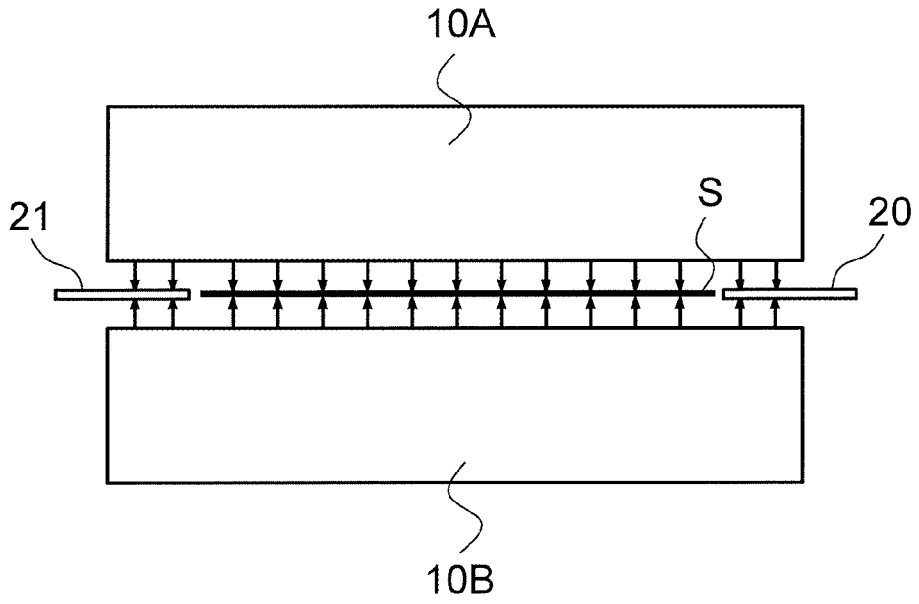
FIG. 13 is a schematic diagram (top view) illustrating one embodiment of a case where baffle plates are placed.

In addition, in the present embodiment, it is preferable that a pair of baffle plates 20 and 21 be arranged beyond both edges in the width direction of the steel strip S or more preferably on the extended plane of the steel strip S in the vicinity of the edges in the width direction of the steel strip S. FIG. 12 and FIG. 13 illustrate respectively the side view and top view of a case where baffle plates 20 and 21 are arranged along with a pair of nozzles 10A and 10B. The baffle plates 20 and 21 are placed between the paired nozzles 10A and 10B. Therefore, the front and back surfaces of the baffle plate face the gas injection ports 11 of the paired nozzles 10A and 10B, respectively. The baffle plates 20 and 21 contribute to decreasing the amount of splash by acting to prevent the gas flows injected from the paired nozzles 10A and 10B from impinging directly on each other. Consequently, by placing the baffle plates, there is an increase in the effect of inhibiting a splash defect from occurring compared with the case of the embodiment described above.

Although there is no particular limitation on the shape of the baffle plates 20 and 21, it is preferable that the shape be rectangular, and it is preferable that two sides of the rectangle be parallel to a direction of the edges extending in the width direction of the steel strip S. It is preferable that the thickness of the baffle plates 20 and 21 be 2 mm to 10 mm. In the case where the thickness is 2 mm or more, the baffle plates are less likely to be deformed due to the pressure of the wiping gas. In the case where the thickness is 10 mm or less, the baffle plates are less likely to come into contact with the wiping nozzles, and thermal deformation is less likely to occur in the baffle plates. It is preferable that the length of the baffle plates 20 and 21 in the passing direction of the steel strip S be set so that the upper edges of the baffle plates are above a position at which the gas flows injected through the paired nozzles 10A and 10B impinge directly on each other otherwise while the lower edges of the baffle plates are below a position located 50 mm above the bath surface. This is because, since there is a decrease in a range in which the jet flows injected through the nozzles facing each other impinge on each other beyond the edge of the steel strip, it is possible to inhibit an edge overcoat defect. Therefore, the baffle plates 20 and 21 may be arranged in such a manner that the lower edges of the baffle plates are immersed in the molten metal bath.

Figure 14:
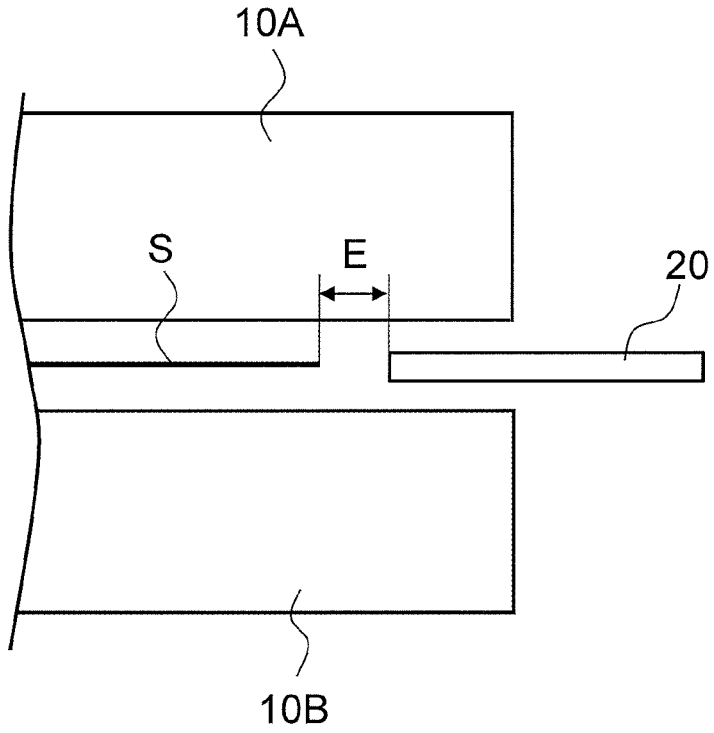
FIG. 14 is an enlarged view of a portion in the vicinity of one edge in the width direction of a steel strip S in FIG. 13.

FIG. 14 is an enlarged view of a portion in the vicinity of one edge in the width direction of the steel strip S in FIG. 13. With reference to FIG. 14, it is preferable that a distance E between the edge in the width direction of the steel strip and the baffle plate be 10 mm or less or more preferably 5 mm or less. Consequently, it is possible to more reliably prevent the jet flows facing each other from impinging directly on each other. In addition, it is preferable that such a distance E be 3 mm or more from the viewpoint of decreasing the possibility of the steel strip coming into contact with the baffle plate when the steel strip meanders.

There is no particular limitation on the material used for the baffle plates. However, in the present embodiment, since the baffle plates are close to the bath surface, it is considered that top dross and splash may adhere to the baffle plates to become alloyed with the baffle plates and firmly fixed to the baffle plates. In addition, in the case where the baffle plates are immersed in the molten metal bath, it is necessary to consider not only the alloying described above but also thermal deformation. From such viewpoints, examples of a material used for the baffle plates include one prepared by spraying boron nitride-based composite, which tends to repel zinc, onto the surface of an iron plate, SUS316L, which is less likely to react with zinc, and the like. Moreover, examples of a preferable material used for the baffle plates include ceramics such as alumina, silicon nitride, silicon carbide, and the like, with which it is possible to inhibit both alloying and thermal deformation.

In addition, examples of a hot-dip metal-coated steel strip which is manufactured by using the gas wiping nozzles and the method for manufacturing a hot-dip metal-coated steel strip according to the present embodiment include a hot-dip galvanized steel strip. The "hot-dip galvanized steel strip" includes both a coated steel sheet (GI) which is not subjected to an alloying treatment after having been subjected to a hot-dip galvanizing treatment and a coated steel sheet (GA) which is subjected to an alloying treatment. However, examples of a hot-dip metal-coated steel strip which is manufactured by using the gas wiping nozzles and the method for manufacturing a hot-dip metal-coated steel strip according to the present embodiment include not only such a hot-dip galvanized steel strip but also hot-dip metal-coated steel strips in general which are coated with aluminum, tin, and other molten metals different from zinc.

One embodiment of the method for manufacturing a hot-dip metal-coated steel strip according to aspects of the present invention includes a step of drawing a graph in such a manner that the horizontal axis represents the angle θ (°) between the injection direction of the gas (wiping gas) and a horizontal plane and the vertical axis represents the ratio D/B of a distance D (mm) between the front edge of the gas injection port 11 and the steel strip S to the width B (mm) of the gas injection port 11, a step of determining an operation range by using (equation 1) to (equation 5) described above in the graph drawn in the step described above, and a step of operating the paired gas wiping nozzles 10A and 10B in the operation range determined in the step described above.

EXAMPLES

Example 1

Hot-dip galvanized steel strips were manufactured under the conditions given in Table 1 by using the continuous hot-dip metal coating equipment 1 having the basic configuration illustrated in FIG. 1 and by feeding steel strips S having a sheet thickness of 1.0 mm and a sheet width of 1200 mm into the molten zinc bath at a sheet passing speed of 1.67 m/s (100 mpm). In addition, regarding the gas wiping nozzles 10A and 10B, the width B of the gas injection ports 11 was 1 mm. In the experiments, the temperature of the molten zinc bath was 460° C., and the temperature T of the gas at the front edges of the gas wiping nozzles was 100° C. or 450° C. In addition, regarding the adhesion amount at the central position in the width direction of the steel sheet, in the conditions given in Table 1, the gas pressure of the gas wiping nozzles (pressure inside the nozzle headers) was adjusted so that the adhesion amount was within the range of (50±5) g/m$^2$.

The splash defect incidence was defined as the ratio of the length of the portion of the steel strip which was judged as to have a splash defect in the inspection process at the exit of the CGL (continuous galvanizing line) with respect to the length of the steel strip which had been passed through the process, and a case of a splash defect incidence of 0.10% or less was judged as "pass". In addition, visual observation was performed on the liquid surface of the molten zinc bath to evaluate the occurrence of the liquid-surface splash.

The bath wrinkle defect was evaluated in accordance with the following criteria in the inspection process at the exit of the CGL.

Δ: hot-dip galvanized steel sheet in which bath wrinkles were visually recognized ○: hot-dip galvanized steel sheet in which bath wrinkles were not visually recognized In addition, a cut steel sheet was taken from a coil at the exit of the CGL, and samples having a diameter of 48 mm for analyzing the adhesion amount were taken at the central position in the width direction of the steel sheet and at a position 50 mm from the edge in the width direction of the steel sheet. The adhesion amounts of the samples obtained were analyzed, and the result was evaluated in terms of edge overcoat ratio (EOC ratio), where the EOC ratio was defined as the ratio of increase in adhesion amount at the edge in the width direction of the steel sheet with respect to adhesion amount at the central position in the width direction of the steel sheet.

A case where the bath wrinkles are judged as "o" and the EOC ratio is 5.0% or less is preferable.

The experimental results are given in Table 1. The conditions of examples 1 to 22 were within the range enclosed by lines expressed by (equation 1) to (equation 5) below in the graph drawn in such a manner that the horizontal axis represents the angle θ (°) between the injection direction of the gas and a horizontal plane and the vertical axis represents the ratio D/B of the distance D (mm) between the front edge of the gas injection port and the steel strip to the width B (mm) of the gas injection port. That is, examples 1 to 22 were examples in which the gas wiping nozzles 10A and 10B were operated in the range described above.

$$D/B = 3 \quad \text{(equation 1)}$$

$$D/B = 0.1 \times \theta + 9 \quad \text{(equation 2)}$$

$$D/B = 12 \quad \text{(equation 3)}$$

$$\theta = 10 \quad \text{(equation 4)}$$

$$\theta = 60 \quad \text{(equation 5)}$$

In the case of the conditions described above, the splash defect incidence was 0.10% or less, and the results were judged as "pass".

In addition, in the case of examples 2, 3, 6, 13, and 14 where the operation was performed under the conditions in the optimum range enclosed by lines expressed by (equation 1) and (equation 6) to (equation 8) below, the liquid-surface splash did not occur, and the EOC ratio was 5.0% or less, that is, it was possible to manufacture steel sheets in which splash defect was inhibited from occurring without consuming excessive zinc.

$$D/B = 3 \quad \text{(equation 1)}$$

$$D/B = 10 \quad \text{(equation 6)}$$

$$\theta = 15 \quad \text{(equation 7)}$$

$$\theta = 45 \quad \text{(equation 8)}$$

On the other hand, in the case of comparative examples 1 to 16 where the conditions were out of the range enclosed by lines expressed by (equation 1) to (equation 5), the splash defect incidence was more than 0.10%, and the results were judged as "fail". In addition, comparative examples 14 to 16 were examples in which the steel strips were manufactured by using the method according to Japanese Unexamined Patent Application Publication No. 2018-9220. In the case of the conditions of comparative examples 14 to 16, the bath wrinkles were inhibited due to the nozzle height being set to be 350 mm. However, since the operation conditions were out of the range described above, there was a deterioration in splash defect, and the results were judged as "fail". In addition, there was a deterioration in edge overcoat.

TABLE 1

| | | Nozzle Angle θ*1 ° | D/B — | Nozzle Tip Height H*2 mm | Adhesion Amount at Width Center g/m² | Splash Defect Incidence % | Pass or Fail | Acceptable Upper Limit of D/B | Melting Point of Molten Metal*3 ° C. | Gas Temperature ° C. | Liquid-surface Splash | Evaluation of Bath Wrinkles | EOC Ratio % |
|---|---|---|---|---|---|---|---|---|---|---|---|---|---|
| Example | 1 | 10 | 10 | 500 | 50 | 0.090 | ○ | 10 | 420 | 100 | none | Δ | 5.6 |
| Example | 2 | 15 | 10 | 500 | 50 | 0.088 | ○ | 10.5 | 420 | 100 | none | Δ | 4.9 |
| Example | 3 | 30 | 10 | 500 | 50 | 0.080 | ○ | 12 | 420 | 100 | none | Δ | 4.8 |
| Example | 4 | 60 | 10 | 500 | 50 | 0.082 | ○ | 12 | 420 | 100 | occurred | Δ | 4.8 |
| Example | 5 | 10 | 3 | 500 | 50 | 0.055 | ○ | 10 | 420 | 100 | none | Δ | 5.1 |
| Example | 6 | 30 | 3 | 500 | 50 | 0.045 | ○ | 12 | 420 | 100 | none | Δ | 3.4 |
| Example | 7 | 60 | 3 | 500 | 50 | 0.052 | ○ | 12 | 420 | 100 | occurred | Δ | 3.5 |
| Example | 8 | 30 | 12 | 500 | 50 | 0.099 | ○ | 12 | 420 | 100 | none | Δ | 5.3 |
| Example | 9 | 60 | 12 | 500 | 50 | 0.096 | ○ | 12 | 420 | 100 | occurred | Δ | 5.4 |
| Example | 10 | 10 | 9 | 500 | 50 | 0.085 | ○ | 10 | 420 | 100 | none | Δ | 5.4 |
| Example | 11 | 10 | 8 | 500 | 50 | 0.078 | ○ | 10 | 420 | 100 | none | Δ | 5.4 |
| Example | 12 | 25 | 11 | 500 | 50 | 0.085 | ○ | 11.5 | 420 | 100 | none | Δ | 5.1 |
| Example | 13 | 25 | 10 | 500 | 50 | 0.073 | ○ | 11.5 | 420 | 100 | none | Δ | 4.8 |
| Example | 14 | 45 | 10 | 500 | 50 | 0.082 | ○ | 12 | 420 | 100 | none | Δ | 4.8 |
| Example | 15 | 50 | 10 | 500 | 50 | 0.085 | ○ | 12 | 420 | 100 | occurred | Δ | 4.7 |
| Example | 16 | 10 | 10 | 40 | 50 | 0.090 | ○ | 10 | 375 | 450 | none | ○ | 5.5 |
| Example | 17 | 10 | 10 | 50 | 50 | 0.090 | ○ | 10 | 375 | 450 | none | ○ | 5.5 |
| Example | 18 | 10 | 10 | 100 | 50 | 0.090 | ○ | 10 | 375 | 450 | none | ○ | 5.5 |
| Example | 19 | 10 | 10 | 200 | 50 | 0.090 | ○ | 10 | 375 | 450 | none | ○ | 5.5 |
| Example | 20 | 10 | 10 | 300 | 50 | 0.090 | ○ | 10 | 375 | 450 | none | ○ | 5.5 |
| Example | 21 | 10 | 10 | 400 | 50 | 0.090 | ○ | 10 | 375 | 450 | none | ○ | 5.5 |
| Example | 22 | 10 | 10 | 650 | 50 | 0.090 | ○ | 10 | 375 | 450 | none | ○ | 5.5 |
| Comparative Example | 1 | 0 | 10 | 500 | 50 | 0.200 | X | — | 420 | 100 | none | Δ | 11.0 |
| Comparative Example | 2 | 2 | 10 | 500 | 50 | 0.178 | X | — | 420 | 100 | none | Δ | 9.9 |
| Comparative Example | 3 | 8 | 10 | 500 | 50 | 0.112 | X | — | 420 | 100 | none | Δ | 6.6 |
| Comparative Example | 4 | 65 | 10 | 500 | 50 | 0.110 | X | — | 420 | 100 | occurred | Δ | 4.8 |
| Comparative Example | 5 | 0 | 3 | 500 | 50 | 0.120 | X | — | 420 | 100 | none | Δ | 5.1 |
| Comparative Example | 6 | 65 | 3 | 500 | 50 | 0.372 | X | — | 420 | 100 | occurred | Δ | 3.5 |
| Comparative Example | 7 | 0 | 20 | 500 | 50 | 0.400 | X | — | 420 | 100 | none | Δ | 21.0 |
| Comparative Example | 8 | 4 | 20 | 500 | 50 | 0.320 | X | — | 420 | 100 | none | Δ | 16.8 |
| Comparative Example | 9 | 65 | 20 | 500 | 50 | 0.577 | X | — | 420 | 100 | none | Δ | 7.3 |
| Comparative Example | 10 | 10 | 11 | 500 | 50 | 0.110 | X | 10 | 420 | 100 | none | Δ | 6.1 |
| Comparative Example | 11 | 30 | 13 | 500 | 50 | 0.111 | X | 12 | 420 | 100 | none | Δ | 5.6 |

TABLE 1-continued

| | | Nozzle Angle θ*1 ° | D/B — | Nozzle Tip Height H*2 mm | Adhesion Amount at Width Center g/m² | Splash Defect Incidence % | Pass or Fail | Acceptable Upper Limit of D/B | Melting Point of Molten Metal*3 ° C. | Gas Temperature ° C. | Liquid-surface Splash | Evaluation of Bath Wrinkles | EOC Ratio % |
|---|---|---|---|---|---|---|---|---|---|---|---|---|---|
| Comparative Example | 12 | 75 | 13 | 500 | 50 | 0.265 | X | — | 420 | 100 | occurred | Δ | 5.6 |
| Comparative Example | 13 | 65 | 12 | 500 | 50 | 0.183 | X | — | 420 | 100 | occurred | Δ | 5.4 |
| Comparative Example | 14 | 10 | 12.5 | 350 | 50 | 0.125 | X | 10 | 420 | 100 | none | ○ | 7.1 |
| Comparative Example | 15 | 30 | 12.5 | 350 | 50 | 0.105 | X | 12 | 420 | 100 | none | ○ | 5.4 |
| Comparative Example | 16 | 75 | 12.5 | 350 | 50 | 0.283 | X | — | 420 | 100 | occurred | ○ | 5.8 |

*1angle between the gas injection direction and the horizontal plane

*2distance between the front edge of the gas injection port and the liquid surface of the molten metal bath

*3molten zinc having a chemical composition containing Zn—0.13Al (wt %) has a melting point of 420° C. molten zinc having a chemical composition containing Zn—4.5Al—0.5Mg—0.05Ni (wt %) has a melting point of 375° C. Underlined portions indicate items out of the range of the present invention.

Example 2

Other examples of the present invention in which, as in the case of Example 1, hot-dip galvanized steel strips having a sheet thickness of 1.0 mm and a sheet width of 1200 mm were manufactured by using the continuous hot-dip metal coating equipment 1 having the basic configuration illustrated in FIG. 1 will be described. In the present example, the hot-dip galvanized steel strips were manufactured under the conditions given in Table 2 by feeding steel strips S into the molten zinc bath at a sheet passing speed of 0.75 m/s to 2.16 m/s (45 mpm to 130 mpm). The width B of the gas injection ports 11 of the gas wiping nozzles 10A and 10B was 1.0 mm to 1.4 mm, and the length G of the parallel parts of the slit gaps was 30 mm. Moreover, in the present example, a pair of baffle plates were placed beyond both edges in the width direction of the steel strip S. The thickness of the baffle plates was 5 mm, the distance E between the edge in the width direction of the steel strip and the baffle plate was 5 mm, and the baffle plates were placed so that the lower edges of the baffle plates were located 30 mm above the liquid surface of the molten zinc bath. The temperature of the molten zinc bath was 460° C., and the temperature T of the gas at the front edges of the gas wiping nozzles was 450° C. The gas pressure of the gas wiping nozzles (pressure inside the nozzle headers) was adjusted so that the adhesion amount at the central position in the width direction of the steel strip S took the values given in Table 2.

The methods for evaluating the splash defect incidence, the liquid-surface splash, bath wrinkles, and the edge overcoat ratio were the same as those used in Example 1. Experimental results are given in Table 2.

Examples 23 to 29 were examples in which the operation was performed under the conditions in the range enclosed by lines expressed by (equation 1) to (equation 5) described above in the graph drawn in such a manner that the horizontal axis represents the angle θ (°) between the injection direction of the gas and a horizontal plane and the vertical axis represents the ratio D/B of the distance D (mm) between the front edge of the gas injection port and the steel strip to the width B (mm) of the gas injection port. Moreover, examples 23 to 29 were examples in which the operation was performed under the conditions in the optimum range enclosed by lines expressed by (equation 1) and (equation 6) to (equation 8) below.

$$D/B = 3 \quad \text{(equation 1)}$$

$$D/B = 10 \quad \text{(equation 6)}$$

$$\theta = 15 \quad \text{(equation 7)}$$

$$\theta = 45 \quad \text{(equation 8)}$$

Moreover, examples 23 to 29 are examples in which the operation was performed under the conditions in which the distance H between the front edge of the gas injection port and the liquid surface of the molten zinc bath was 50 mm or more and 700 mm or less and in which the temperature T (° C.) of the gas immediately after having been injected through the gas wiping nozzles satisfied the relational expression $TM-150 \leq T \leq TM+250$ in relation to the melting point TM (° C.) of molten zinc.

From the results given in Table 2, it was clarified that, in the case of examples 23 to 29, the splash defect incidence was 0.10% or less, and the results were judged as "pass". In addition, the liquid-surface splash did not occur, and the EOC ratio was 5.0% or less. From the results described above, it was clarified that, in the case of the present example, since it is possible to inhibit splash from adhering to the steel strip, it is possible to manufacture a hot-dip galvanized steel strip in which a splash defect was inhibited from occurring. In addition, it is possible to prevent a deterioration in the surface quality of a hot-dip galvanized steel strip due to bath wrinkles and the like, and it is possible to manufacture a hot-dip galvanized steel strip with which it is possible to improve the yield ratio of zinc by inhibiting edge overcoat.

TABLE 2

| | Nozzle Angle θ*1 ° | D/B — | Nozzle Tip Height H*2 mm | Adhesion Amount at Width Center g/m$^2$ | Sheet Passing Speed m/s | Nozzle Pressure kPa | Splash Defect Incidence % | Pass or Fail | Acceptable Upper Limit of D/B | Melting Point of Molten Metal ° C. | Gas Temp-erature ° C. | Liquid-surface Splash | Evaluation of Bath Wrinkles | EOC Ratio % |
|---|---|---|---|---|---|---|---|---|---|---|---|---|---|---|
| Example 23 | 17 | 4 | 480 | 20 | 1.63 | 35 | 0.057 | ○ | 10.7 | 375 | 450 | none | ○ | 4.2 |
| Example 24 | 17 | 5 | 480 | 30 | 1.83 | 35 | 0.062 | ○ | 10.7 | 375 | 450 | none | ○ | 4.3 |
| Example 25 | 17 | 4 | 380 | 60 | 2.00 | 20 | 0.057 | ○ | 10.7 | 375 | 450 | none | ○ | 4.2 |
| Example 26 | 17 | 6 | 320 | 70 | 2.16 | 21 | 0.067 | ○ | 10.7 | 375 | 450 | none | ○ | 4.4 |
| Example 27 | 19 | 6 | 260 | 90 | 1.35 | 9 | 0.066 | ○ | 10.9 | 375 | 450 | none | ○ | 4.3 |
| Example 28 | 25 | 6 | 230 | 140 | 0.75 | 3 | 0.063 | ○ | 11.5 | 375 | 450 | none | ○ | 4.2 |
| Example 29 | 25 | 7 | 210 | 180 | 0.83 | 3 | 0.068 | ○ | 11.5 | 375 | 450 | none | ○ | 4.3 |

*1angle between the gas injection direction and the horizontal plane

*2distance between the front edge of the gas injection port and the liquid surface of the molten metal bath

REFERENCE SIGNS LIST

S steel strip
1 continuous hot-dip metal coating equipment
2 snout
3 coating tank
4 molten metal bath
5 sink roll
6 support roll
10A, 10B gas wiping nozzle
11 gas injection port
12 nozzle header
13A upper nozzle member
13B lower nozzle member
20, 21 baffle plate
131A external tapered portion of upper nozzle member
131B external tapered portion of lower nozzle member

The invention claimed is:

1. A method for manufacturing a hot-dip metal-coated steel strip, the method comprising: continuously dipping a steel strip in a molten metal bath; pulling up the steel strip from the molten metal bath; injecting a gas onto the pulled-up steel strip by using paired gas wiping nozzles arranged on both front and back surface sides of the steel strip, the paired gas wiping nozzles having slit gas injection ports extending in a width direction of the steel strip to a range wider than a width of the steel strip, the gas being injected through the slit gas injection ports to adjust an adhesion amount of molten metal which adheres to both surfaces of the steel strip; and continuously manufacturing the hot-dip metal-coated steel strip, wherein the method has a splash defect incidence rate of 0.10% or less, wherein each of the paired gas wiping nozzles has a nozzle header and an upper nozzle member and a lower nozzle member which are connected to the nozzle header, wherein, in a cross-sectional view in a direction perpendicular to the width direction of the steel strip, front edge portions of the upper nozzle member and the lower nozzle member are parallel to and face each other to form the gas injection port, wherein the gas is passed through the nozzle header and injected through the gas injection port, and wherein, when a graph is drawn in such a manner that a horizontal axis represents an angle θ (°) between an injection direction of the gas injected through each of the gas injection ports and a horizontal plane and a vertical axis represents a ratio D/B of a distance D (mm) between a front edge of the gas injection port and the steel strip to a width B (mm) of the gas injection port, the paired gas wiping nozzles are operated under conditions in a range enclosed by lines expressed by (equation 1) to (equation 5) below:

$$D/B = 3 \quad \text{(equation 1)}$$

$$D/B = 0.1 \times \theta + 9 \quad \text{(equation 2)}$$

$$D/B = 12 \quad \text{(equation 3)}$$

$$\theta = 10 \quad \text{(equation 4)}$$

$$\theta = 60. \quad \text{(equation 5)}$$

2. The method for manufacturing a hot-dip metal-coated steel strip according to claim 1, wherein a distance H between each front edge of the gas injection ports of the paired gas wiping nozzles and a liquid surface of the molten metal bath is 50 mm or more and 700 mm or less, and wherein a temperature T (° C.) of the gas immediately after injected through the paired gas wiping nozzles satisfies a relational expression TM−150≤T≤TM+250 in relation to a melting point TM (° C.) of the molten metal.

3. The method for manufacturing a hot-dip metal-coated steel strip according to claim 2, wherein baffle plates are placed between the paired gas wiping nozzles so as to face the gas injection ports on outsides of both edges in the width direction of the steel strip.

4. The method for manufacturing a hot-dip metal-coated steel strip according to claim 1, wherein an internal pressure of the nozzle header is 2 kPa to 70 kPa.

5. The method for manufacturing a hot-dip metal-coated steel strip according to claim 4, wherein baffle plates are placed between the paired gas wiping nozzles so as to face the gas injection ports on outsides of both edges in the width direction of the steel strip.

6. The method for manufacturing a hot-dip metal-coated steel strip according to claim 1, wherein baffle plates are placed between the paired gas wiping nozzles so as to face the gas injection ports on outsides of both edges in the width direction of the steel strip.

* * * * *